US011834976B2

(12) United States Patent
Zipfel et al.

(10) Patent No.: US 11,834,976 B2
(45) Date of Patent: Dec. 5, 2023

(54) ELECTRIC GAS FLOW HEATER AND VEHICLE

(71) Applicant: Faurecia Emissions Control Technologies, Germany GmbH, Augsburg (DE)

(72) Inventors: Toni Zipfel, Augsburg (DE); Maximilian Kuhnert, Augsburg (DE)

(73) Assignee: Faurecia Emissions Control Technologies, Germany GmbH

( * ) Notice: Subject to any disclaimer, the term of this patent is extended or adjusted under 35 U.S.C. 154(b) by 0 days.

(21) Appl. No.: 17/772,678

(22) PCT Filed: Oct. 19, 2020

(86) PCT No.: PCT/EP2020/079375
§ 371 (c)(1),
(2) Date: Apr. 28, 2022

(87) PCT Pub. No.: WO2021/083705
PCT Pub. Date: May 6, 2021

(65) Prior Publication Data

US 2022/0372904 A1 Nov. 24, 2022

(30) Foreign Application Priority Data

Oct. 30, 2019 (DE) ..... 10 2019 129 322.7

(51) Int. Cl.
*F01N 3/20* (2006.01)
*H05B 3/06* (2006.01)
(Continued)

(52) U.S. Cl.
CPC ..... *F01N 3/2013* (2013.01); *H05B 3/06* (2013.01); *H05B 3/10* (2013.01); *F01N 3/027* (2013.01);
(Continued)

(58) Field of Classification Search
CPC combination set(s) only.
See application file for complete search history.

(56) References Cited

U.S. PATENT DOCUMENTS 5,174,968 A * 12/1992 Whittenberger ..... F01N 3/2857 502/527.22
5,519,191 A 5/1996 Ketcham et al.
(Continued)

FOREIGN PATENT DOCUMENTS

CN 104995456 A 10/2015
CN 108691617 A 10/2018
(Continued)

OTHER PUBLICATIONS

International Preliminary Report on Patentability for PCT Application No. PCT/EP2020/079375 dated May 12, 2022.

*Primary Examiner* — Binh Q Tran
(74) *Attorney, Agent, or Firm* — Carlson, Gaskey & Olds, P.C.

(57) ABSTRACT

An electric gas flow heater has a grid-like heating element through which exhaust gas can flow axially, and which forms an electrical resistance heating. The grid-like heating element includes radially successive layers of band-like material, wherein the layers, in an axial view of the heating element, are bent in an undulating manner and include valleys and peaks. The layers that are located between the radially outermost layer and the radially innermost layer are attached by their peaks and valleys to the respectively radially adjacent layer, so that flow-through openings are formed between the layers. The wavelengths of the layers are increasing radially outwards.

19 Claims, 2 Drawing Sheets

(51) Int. Cl.

| | |
|---|---|
| ***H05B 3/10*** | (2006.01) |
| ***F01N 3/027*** | (2006.01) |
| ***F01N 3/029*** | (2006.01) |

(52) U.S. Cl.
CPC ..... *F01N 3/0275* (2013.01); *F01N 3/0296* (2013.01); *F01N 3/2026* (2013.01); *F01N 2240/04* (2013.01); *F01N 2240/16* (2013.01); *F01N 2550/22* (2013.01); *F01N 2900/04* (2013.01); *F01N 2900/0602* (2013.01); *H05B 2203/023* (2013.01)

(56) References Cited

U.S. PATENT DOCUMENTS

| | | | | |
|---|---|---|---|---|
| 5,582,805 | A | 12/1996 | Yoshizaki et al. | |
| 5,744,104 | A * | 4/1998 | Sakurai | B01J 35/0033 422/174 |
| 6,544,310 | B2 | 4/2003 | Badeau et al. | |
| 8,252,077 | B2 * | 8/2012 | Gonze | F01N 9/002 55/282.3 |
| 9,366,438 | B2 | 6/2016 | Rajaram et al. | |
| 10,598,064 | B2 * | 3/2020 | Everly | F01N 3/027 |
| 10,731,530 | B2 * | 8/2020 | Bartolo | F01N 3/20 |
| 2014/0223914 | A1 | 8/2014 | Rajaram et al. | |
| 2018/0291787 | A1 * | 10/2018 | Bartolo | H05B 3/03 |
| 2019/0234266 | A1 | 8/2019 | Bartolo et al. | |
| 2022/0178290 | A1 * | 6/2022 | Gaiser | F01N 3/021 |

FOREIGN PATENT DOCUMENTS

| | | | |
|---|---|---|---|
| CN | 108882402 | A | 11/2018 |
| CN | 110107382 | A | 8/2019 |
| DE | 102005063081 | A1 | 7/2007 |
| DE | 102018108032 | A1 | 10/2018 |
| EP | 3404248 | A1 | 11/2018 |
| EP | 3424363 | A1 | 1/2019 |
| JP | 000H08100642 | A | 4/1996 |
| JP | 2004351292 | A | 12/2004 |
| KR | 000101134648 | B1 | 3/2011 |
| WO | 2017151975 | A1 | 9/2017 |

* cited by examiner

ELECTRIC GAS FLOW HEATER AND VEHICLE

CROSS-REFERENCE TO RELATED APPLICATIONS

This application is the US national phase of PCT/EP2020/079375, which was filed on Oct. 19, 2020.

FIELD OF THE DISCLOSURE

The disclosure relates to an electric gas flow heater and a vehicle having an electric gas flow heater.

BACKGROUND

Gas flow heaters are typically disposed in a gas stream and are used to heat the gas flowing through the gas flow heater.

An exemplary application for such gas flow heaters is the heating of air in hair dryers.

Electric gas flow heaters are also employed in the automotive sector. Here, for example, they are referred to as exhaust gas heaters.

In order to limit the emission of pollutants from internal combustion engines of motor vehicles, it is known to use exhaust gas purification devices, such as, for example, catalytic converters, particulate filters or the like, for exhaust gas purification.

To ensure catalytically assisted conversion of the pollutants, the exhaust gas or the exhaust gas purification device must have a specified minimum temperature. In particular after a cold start or restart of the internal combustion engine, such a minimum temperature has not yet been reached.

Therefore, usually the exhaust gas purification device itself is electrically heated to reach or maintain the specified minimum temperature.

Separate exhaust gas heaters may also be provided, which include a heating grid that heats up when current flows. These exhaust gas heaters are then generally arranged in an exhaust duct of a vehicle upstream of a catalytic converter or a particulate filter in the direction of exhaust gas flow, and heat an exhaust gas flowing in the exhaust duct before it flows through the exhaust gas purification device.

The heating grids of conventional gas flow heaters are generally produced by subtractive methods, such as, for example, shearing, metal cutting or etching. However, this leaves a large amount of material as unused process residue. Accordingly, a lot of material has to be used relative to the amount of material of the final product, which makes production cost-intensive. In addition, the above-mentioned methods are imprecise, which may result in uneven current flow in the finished heating grid, which consequently results in uneven heating.

SUMMARY

An electric gas flow heater is provided that can be manufactured easily with little or no cutting scrap, and which ensures uniform heating of the gas.

The electric gas flow heater has a grid-like heating element through which gas can flow axially, and which forms an electrical resistance heating. The grid-like heating element includes radially successive layers of band-like material, wherein the layers, in an axial view of the heating element, are bent in an undulating manner and include valleys and peaks. The layers that are located between a radially outermost layer and a radially innermost layer are attached by their peaks and valleys to their radially immediately adjacent layers, so that flow-through openings are formed between the layers. That is, the valleys are attached to a layer adjacent on this radial side, and like valleys attached on their radially outer side and thus to the oppositely adjacent layer. The valleys and peaks extend over the entire width of the band, with the wavelengths of the layers increasing radially outward. The increase in the wavelengths of the radially offset layers allows to have the peaks or valleys of one layer abut in an area of the valleys or peaks of the neighboring layer(s). In this way, a uniform pattern of the heating element and, as a result, a uniform current flow and uniform heating can be achieved. The outermost and innermost layers have, of course, only one adjacent layer, to which they are attached by their valleys or peaks and aligned there with peaks or valleys, respectively. The material in band form can be manufactured very easily, significantly reducing or avoiding a loss of material in manufacturing. In addition, the band or bands, as viewed in the direction of gas flow, can be manufactured to be axially longer to any desired extent. Also, the band or bands, as viewed in the direction of gas flow, can be manufactured to be thinner than is possible in the prior art. In addition, the band or bands can be bent to a sinusoidal shape very easily.

According to one aspect, each valley and each peak of a layer lie on a radial straight line on which a valley or a peak of the layer adjacent radially inside and radially outside is located. In this way, a substantially symmetrical pattern of the heating element can be formed and, as a result, the uniformity of current flow and of the heating can be further increased.

It may be provided here that each layer is formed by a separate band of its own. The separate bands can be inserted very easily into a separate carrier structure of the electric gas flow heater.

In particular, the individual layers are arranged concentrically. This allows a uniform layer structure to be formed, as a result of which a uniform heating of the gas by the electric gas flow heater can be achieved.

Alternatively, the layers are formed by band sections lying on top of each other of a band, in particular a continuous and endlessly wound band which, after each full circulation, "jumps" to a next level or layer by a bending of the band. Thus, only one band needs to be installed for one grid. In addition, winding of the band-like material can be performed in one manufacturing step. This drastically facilitates and shortens the manufacturing of the heating element.

To produce a stable heating grid, the layers may be connected to each other by a current-conducting attachment, for example soldering, welding or gluing. At the same time, this allows the stability of the heating element to be increased. The connection of the layers is current-conducting since it is only in this way that a uniform current flow and consequently a uniform heating can be ensured.

To further increase the stability of the heating element, the radially outermost layer may be surrounded by a terminating ring, to which the radially outermost layer is attached. The terminating ring may additionally serve to fasten the electric gas flow heater in the gas duct.

For example, the terminating ring may be a pinion having an internal toothing. The number of teeth corresponds to the number of undulations of the band of the last layer, so that the teeth are connected to the peaks of the last layer of the band.

A prefabricated disk or prefabricated ring around which the layers extend and to which the innermost layer is attached may be provided in the center. In this way, the stability of the heating element can be increased. The attachment of the innermost layer to the disk or ring may serve as a starting point from which the one band is spirally wound to manufacture the heating element.

For example, the disk is a pinion having an external toothing, the number of teeth of which corresponds to the number of undulations of the band of the first layer. The teeth are connected to the valleys of the first layer of the band.

In particular, the heating element, the terminating ring, and the disk or ring in the center constitute a structural unit.

One embodiment provides that in addition to the valleys and peaks, the at least one band forming the layers or a layer has local indentations and protrusions the amplitude of which is smaller, in particular smaller by a factor of 4, than the amplitude between neighboring valleys and peaks and/or which extend over only part of the width of the band. In this way, the surface area of the at least one band is increased, allowing a higher heat transfer between the band and the gas and thus more efficient heating of the gas. These indentations and protrusions are only small local deviations from the originally flat band shape.

Within a layer, the radial thickness and/or an axial height as viewed in the direction of flow is the same. This allows a uniform current flow within one layer and therefore a uniform heating by the one layer to be achieved.

The layers have equal or different radial thicknesses and/or equal or different axial heights in the flow direction in comparison to each other. If the radial thicknesses and/or axial heights are equal, a uniform current flow can be achieved across all layers and thus in the entire heating element, thus achieving a uniform heating of the gas by the heating element. If the radial thicknesses and/or axial heights are different, some layers may be selectively formed to have a smaller or greater thickness in comparison to the other layers, whereby a lower or higher degree of heating can be achieved in these areas. In other words, purely by design, areas can be prefabricated in which different heating requirements are to be achieved, as a result of which no electronic control is required in these areas.

The electric gas flow heater is positioned in particular immediately upstream of a gas purification device, for example a catalytic converter or a particulate filter. In this way, the gas is heated immediately upstream of the gas purification device, in which a particular minimum temperature has to prevail for optimum and efficient conversion of the pollutants within the gas or for purification of the gas. By positioning the electric gas flow heater immediately upstream of the gas purification device, the gas can be heated to the minimum temperature very quickly.

Provision may be made that the electric gas flow heater and the gas purification device contact each other. This minimizes the distance the gas has to travel between the electric gas flow heater and the gas purification device, which significantly reduces the heat loss of the gas within the gas duct.

Optionally, the electric gas flow heater may be mounted to the gas purification device upstream. In this way, too, the heat loss of the gas in the gas duct may be reduced by the distance to be travelled between the electric gas flow heater and the gas purification device being minimal. Furthermore, in this way an additional attachment of the electric gas flow heater within the gas duct can be saved.

Furthermore, the disclosure comprises a vehicle having an internal combustion engine and an electric gas flow heater of the type mentioned above, by which the exhaust gas of the vehicle is heated. This allows the exhaust gas to be quickly heated to the minimum temperature for ensuring catalytically assisted conversion of the pollutants after a cold start or restart of the internal combustion engine, thus allowing the emission of pollutants during the cold start to be significantly reduced.

The advantages and properties as described of the electric gas flow heater according to the disclosure are equally applicable to the vehicle, and vice versa.

Further advantages and characteristics will be apparent from the description below and from the drawings.

DETAILED DESCRIPTION

As already discussed above, the electric gas flow heater can be used for various purposes in which a gas is to be heated.

In the following, only the use of the electric gas flow heater to heat an exhaust gas of the vehicle will be described in greater detail.

Figure 1:
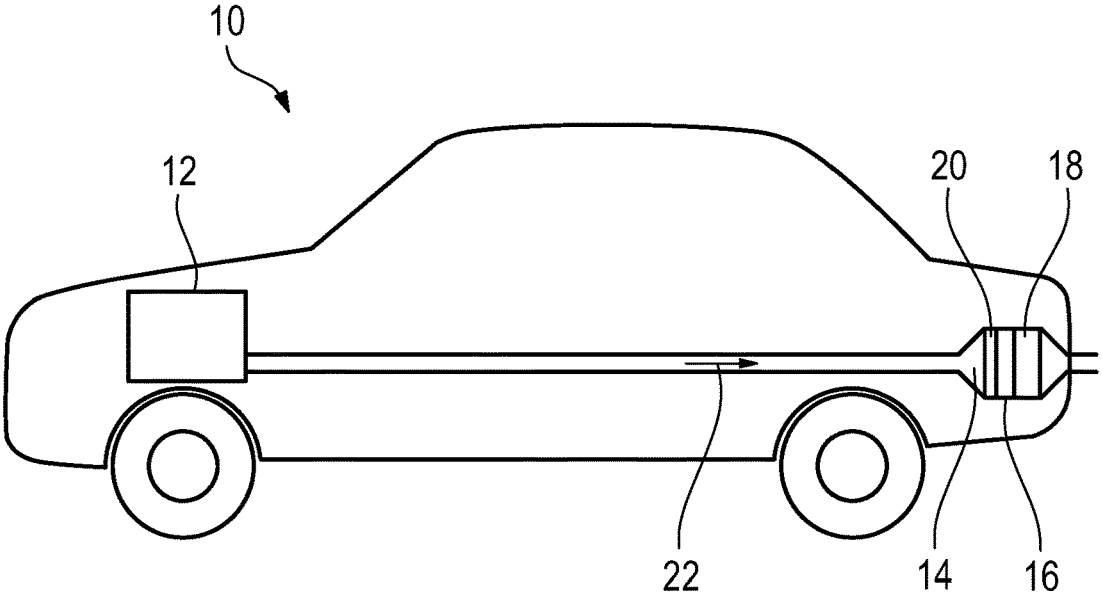
FIG. 1 shows a schematic longitudinal section of a vehicle with an exhaust duct, an electric gas flow heater according to the disclosure, and an exhaust gas purification device.

FIG. 1 shows a vehicle 10 having an internal combustion engine 12 and an exhaust line in which a purification unit 14 is accommodated. The purification unit 14 is defined by an outer housing 16 and includes an exhaust gas purification device 18 and an exhaust gas flow heater 20.

The exhaust gas purification device 18 is, for example, a catalytic converter.

In the embodiment illustrated here, the exhaust gas flow heater 20 is arranged spaced apart from and upstream of the exhaust gas purification device 18 in the exhaust gas flow direction 22.

The exhaust gas flow heater 20 may, however, also abut against the exhaust gas purification device 18 so that they are in contact and, accordingly, there is no distance between the exhaust gas flow heater 20 and the exhaust gas purification device 18. In other words, the exhaust gas flow heater 20 may be positioned immediately upstream of the exhaust gas purification device 18.

In the embodiment shown herein, the exhaust gas flow heater 20 and the exhaust gas purification device 18 are each attached to the outer housing 16 and constitute a pre-assembled unit therewith.

Alternatively, the exhaust gas flow heater 20 may also be mounted directly to the exhaust gas purification device 18, for example in a separate, additional housing of the exhaust gas purification device 18.

Figure 2:
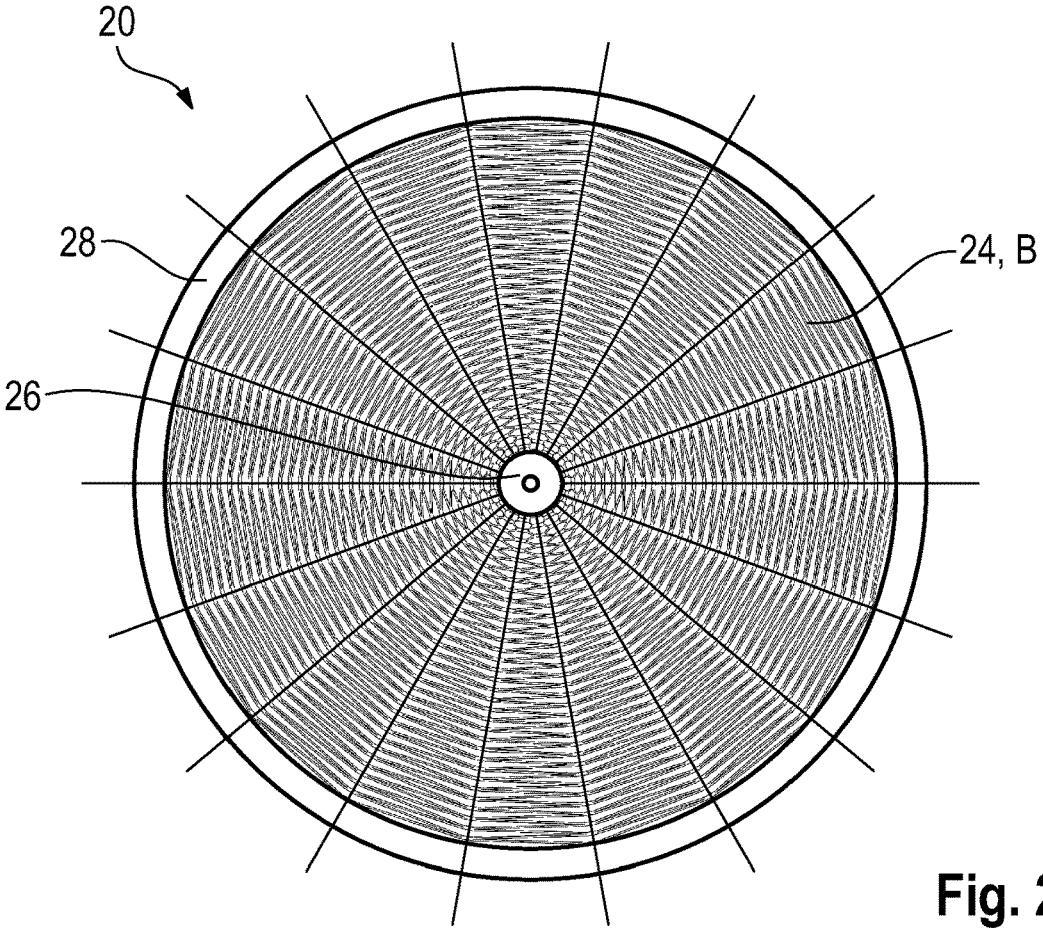
FIG. 2 shows a top view of the electric gas flow heater according to the disclosure as shown in FIG. 1.

FIG. 2 shows the exhaust gas flow heater 20 as viewed in the exhaust gas flow direction 22. The exhaust gas flow heater 20 comprises a heating element 24, a radially inner disk or radially inner ring 26, and a radially outer terminating ring 28.

The heating element 24 has at least one band-like material or band B that is formed as a type of elongated and electrically conductive sheet.

In particular, the band B is an elongated metal sheet such as, for example, a stainless steel sheet.

The band B is arranged with its longitudinal edge circumferentially around the ring 26, and the width of the band B is oriented in the exhaust gas flow direction 22. The width has previously also been referred to as the axial height. Accordingly, in FIG. 2, only a side surface of a longitudinal edge of the band B is visible, this side surface being defined by a length of the longitudinal edge and a band thickness.

The band thickness may be the same over the entire band or may vary.

Figure 3:
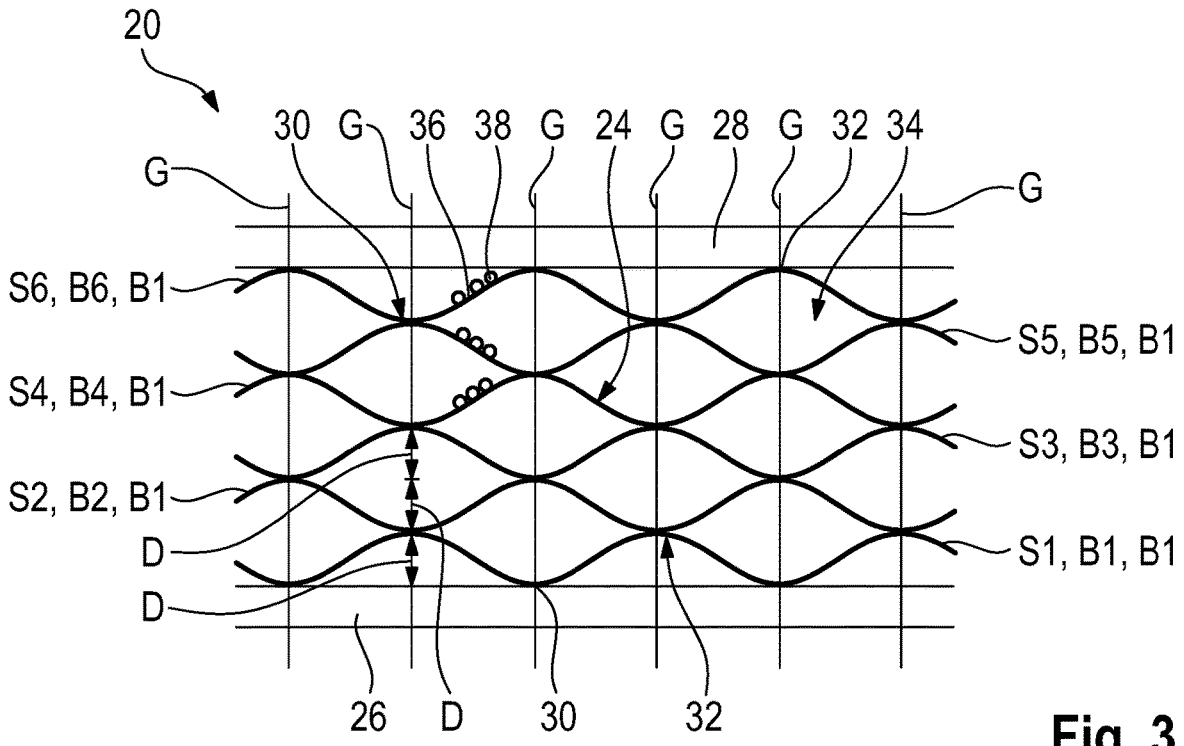
FIG. 3 shows a schematic detail view of the electric gas flow heater according to the disclosure as shown in FIG. 2.

In FIG. 3, a detail of the exhaust gas flow heater 20 is shown in detail in a simplified form.

The heating element 24 is arranged in a plurality of layers S1 to S6 between the two rings 26, 28, only a few layers being depicted here in order to simplify the drawing.

Here, the radially innermost, first layer S1 is attached to the radially inner ring 26 and the radially outermost, last layer S6 is attached to the radially outer ring 28, in particular in a current-conducting manner, for example by soldering, welding or gluing.

Figure 4:
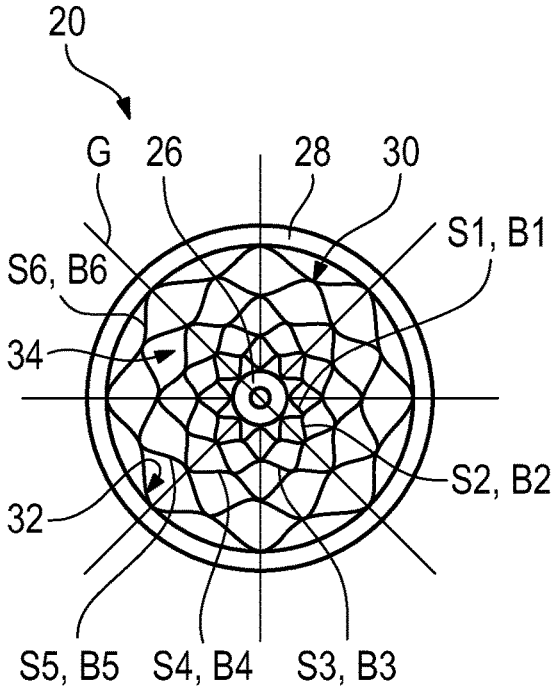
FIG. 4 shows a schematic, simplified top view of a first embodiment of the electric gas flow heater according to the disclosure as shown in FIG. 2.
Figure 5:
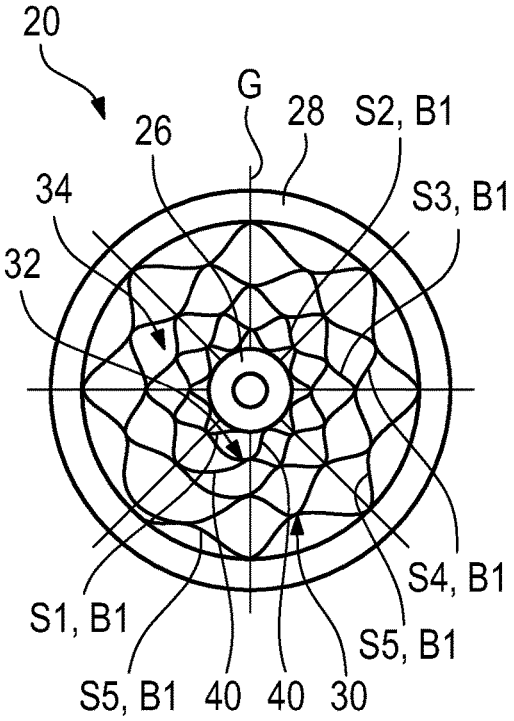
FIG. 5 shows a schematic, simplified top view of a second embodiment of the electric gas flow heater according to the disclosure as shown in FIG. 2.

Each layer S1-S6 may be formed here by its own separate band B1 to B6 (see FIG. 4) or by a single continuous band B1 (see FIG. 5).

The band B1 or bands B1-B6 each have an undulating shape, forming valleys 30 and peaks 32.

Within a layer S1-S6, a radial thickness D and an axial height, as viewed in the direction of flow, are substantially the same.

In particular, all layers S1-S6 have substantially equal radial thicknesses and/or axial heights when compared to each other.

Alternatively, the layers S1-S6 may have different radial thicknesses and/or axial heights when compared to each other.

Furthermore, the band width as measured in the axial direction is always constant throughout all layers S1-S6.

The band B1 or the bands B1-B6 may have smallish indentations 36 and opposing protrusions 38 to increase the surface area of the band B1 or the bands B1-B6, which are preferably produced by impressions in band B1 or in the bands B1-B6 before creating the valleys and peaks by bending.

These indentations 36 and protrusions 38, which are optionally provided in addition to the valleys 30 and peaks 32, have an amplitude which is much smaller, in particular smaller by a factor of 4, than the amplitude between neighboring valleys 30 and peaks 32, and/or extend only over part of the width of the band B1 or the bands B1-B6.

Accordingly, the indentations 36 and protrusions 38 do not form valleys 30 and peaks 32.

The layers S, which are each radially adjacent to each other, are attached to each other by their valleys 30 and peaks 32 in a current-conducting manner.

The first layer S1 is attached to the ring 26 exclusively by its valleys 30 and the last layer S6 is attached to the terminating ring 28 exclusively by its peaks 32, in particular in a current-conducting manner. As regards the other layers S2 to S5, the valleys 30 are attached to the peaks 32 of the radially inner layer S in the region of the peaks 32 in a current-conducting manner, and the peaks 32 are attached to the valleys 30 of the radially outer layer S in the region of the valleys 30 in a current-conducting manner.

The attachment, in particular current-conducting attachment, is effected, for example, by soldering, welding or gluing.

In the embodiment shown, the radially neighboring layers S are attached to each other in such a way that each valley 30/each peak 32 lies on a radial straight line G on which a peak 32/a valley 30 of the radially inwardly adjacent layer S and a valley 30/a peak 32 of the radially outwardly adjacent layer S are located.

In a different embodiment, the valleys 30/peaks 32 of a layer S may abut the peaks 32/valleys 30 of the adjacent layers S slightly offset from the peaks 32/valleys 30 of the adjacent layers S.

Flow-through openings 34 are formed between the layers S1-S6 by the arrangement described above, through which the exhaust gas can flow.

To heat the exhaust gas flowing through the flow-through openings 34, a current is applied to the band B1 or the bands B1-B6 of the heating element 24.

The current can be distributed uniformly over the entire heating element via the connection points along the straight line G between the radially innermost layer S1 and the inner ring 26, between the radially outermost layer S6 and the terminating ring 28, and between the individual layers S1-S6.

It may be provided here that the ring 26 and the terminating ring 28 are also made of an electrically conductive material.

When current flows, the band B1 or bands B1-B6 heat up, which causes the exhaust gas flowing through the flow-through openings 34 to also heat up.

Accordingly, the heating element 24 forms an electrical resistance heating.

FIGS. 4 and 5 illustrate a first and a second embodiment of the heating element 24. For reasons of clarity, not all of the radial straight lines G are drawn in these figures.

In the first embodiment, the individual layers S1-S6 are each formed by an individual, separate band B1 to B6. Therefore, here the number of layers S1-S6 corresponds to the number of bands B1-B6.

The bands B1-B6 are arranged concentrically with each other here. The features described so far with reference to FIGS. 2 and 3 are provided here as well.

In contrast, in the second embodiment the individual layers S1-S6 are formed by a single continuous band B1.

Here, starting from the radially inner ring 26, the band B1 extends in ring-like layers radially outwards to the terminating ring 28. In other words, the layers S1-S6 are formed by band sections of the wound band B1 lying on top of each other, wherein the band B1 "jumps" to the next layer by an angled portion 40 after a circulation through 360 degrees. In FIG. 5, two angled portions 40 are provided with reference numbers.

In both embodiments, the attachment points of the valleys 30 and peaks 32 of two radially neighboring layers S each lie on the straight lines G.

This requires that the number of valleys 30 and peaks 32 of neighboring layers S be exactly equal. In particular, the number of valleys 30 and peaks 32 of all layers S1-S6 is exactly equal.

The radius and circumference of a layer S increases as the radial distance from the radially inner ring 26 increases; the radial layer thickness, or thickness D for short, remains constant.

To ensure that the number of valleys 30 and peaks 32 of all layers S, and thus also of neighboring layers S, is the same, the wavelength of a band B1, B1-B6 increases as the radial distance from the radially inner ring 26 increases.

As an alternative, in other embodiments, the valleys 30/peaks 32 of a layer S may abut the peaks 32/valleys 30 of the adjacent layers S slightly offset from the peaks 32/valleys 30 of the adjacent layers S. In this case, the number of valleys 30 and peaks 32 of neighboring layers S need not be exactly the same.

Although various embodiments have been disclosed, a worker of ordinary skill in this art would recognize that certain modifications would come within the scope of this disclosure. For that reason, the following claims should be studied to determine the true scope and content of this disclosure.

The invention claimed is:

1. An electric gas flow heater, comprising:

a grid-like heating element through which gas can flow axially and which forms an electrical resistance heating, and wherein the grid-like heating element includes radially successive layers of band-like material, wherein the radially successive layers, in an axial view of the grid-like heating element, are bent in an undulating manner and include valleys and peaks, wherein the radially successive layers that are located between a radially outermost layer and a radially innermost layer are attached by the peaks and the valleys to radially adjacent layers, so that flow-through openings are formed between the radially successive layers, and wherein wavelengths of the radially successive layers increase radially outwards.

2. The electric gas flow heater according to claim 1, wherein each valley and each peak of a layer of the radially successive layers lie on a radial straight line on which the valley or the peak of the layer adjacent radially inside and radially outside is located.

3. The electric gas flow heater according to claim 1, wherein each radially successive layer is formed by a separate band.

4. The electric gas flow heater according to claim 1, wherein the radially successive layers are formed by band sections of a single continuous wound band lying on top of each other.

5. The electric gas flow heater according to claim 1, wherein the radially successive layers are connected to each other by a current-conducting attachment.

6. The electric gas flow heater according to claim 1, wherein the radially outermost layer is surrounded by a terminating ring, to which the radially outermost layer is attached.

7. The electric gas flow heater according to claim 1, wherein a prefabricated disk or prefabricated ring around which the radially successive layers extend and to which the radially innermost layer is attached is provided in a center.

8. The electric gas flow heater according to claim 1, wherein in addition to the valleys and the peaks, at least one band forms at least one layer of the radially successive layers and has indentations and protrusions an amplitude of which is smaller than an amplitude between neighboring valleys and peaks and/or which extend only over part of a width of the at least one band.

9. The electric gas flow heater according to claim 1, wherein within a layer of the radially successive layers, a radial thickness of the layer is the same.

10. The electric gas flow heater according to claim 9, wherein the radially successive layers have equal radial thicknesses in comparison to each other.

11. The electric gas flow heater according to claim 1, wherein the electric gas flow heater is positioned upstream of an exhaust gas purification device and constitutes a unit therewith.

12. A vehicle comprising: an internal combustion engine and the electric gas flow heater according to claim 1 by which exhaust gas of the vehicle is heated.

13. The electric gas flow heater according to claim 1, wherein each radially successive layer surrounds a center of the grid-like heating element.

14. The electric gas flow heater according to claim 13, wherein the radially outermost layer extends completely around the radially innermost layer.

15. The electric gas flow heater according to claim 1, including a radially inner disk or a radially inner ring, and wherein the radially innermost layer immediately surrounds the radially inner disk or the radially inner ring.

16. The electric gas flow heater according to claim 15, wherein each radially successive layer has an undulating shape formed by alternating valleys and peaks, and wherein the radially innermost layer is attached to the radially inner disk or the radially inner ring exclusively at the valleys.

17. The electric gas flow heater according to claim 15, including a radially outer terminating ring that surrounds the radially outermost layer, and wherein the radially outermost layer is attached to the radially outer terminating ring exclusively at the peaks.

18. The electric gas flow heater according to claim 1, including a radially outer terminating ring that completely surrounds the radially outermost layer, and wherein the radially outermost layer is attached to the radially outer terminating ring at a plurality of discrete points that are circumferentially spaced apart from each other.

19. The electric gas flow heater according to claim 18, wherein the radially outermost layer completely surrounds the radially innermost layer, and including a radially inner disk or a radially inner ring that is completely surrounded by the radially innermost layer, and wherein the radially innermost layer is attached to the radially inner disk or the radially inner ring at a plurality of discrete points that are circumferentially spaced apart from each other.

* * * * *